US011114228B2

(12) United States Patent
Ueyama et al.

(10) Patent No.: US 11,114,228 B2
(45) **Date of Patent: *Sep. 7, 2021**

(54) MAGNETIC POWDER COMPOSITE, ANTENNA AND ELECTRONIC DEVICE, AND METHOD FOR PRODUCING THE SAME

(71) Applicant: DOWA ELECTRONICS MATERIALS CO., LTD., Tokyo (JP)

(72) Inventors: Toshihiko Ueyama, Tokyo (JP); Masahiro Gotoh, Tokyo (JP); Takayuki Yoshida, Tokyo (JP); Takuyuki Baba, Tokyo (JP)

(73) Assignee: DOWA ELECTRONICS MATERIALS CO., LTD., Tokyo (JP)

( * ) Notice: Subject to any disclaimer, the term of this patent is extended or adjusted under 35 U.S.C. 154(b) by 557 days.

This patent is subject to a terminal disclaimer.

(21) Appl. No.: 15/578,471

(22) PCT Filed: Jun. 1, 2016

(86) PCT No.: PCT/JP2016/066148

§ 371 (c)(1),
(2) Date: Nov. 30, 2017

(87) PCT Pub. No.: WO2016/194936

PCT Pub. Date: Dec. 8, 2016

(65) Prior Publication Data

US 2018/0151279 A1 May 31, 2018

(30) Foreign Application Priority Data

Jun. 2, 2015 (JP) ..... JP2015-112704

(51) Int. Cl.

| | |
|---|---|
| ***H01F 1/26*** | (2006.01) |
| ***H01F 1/11*** | (2006.01) |
| ***B22F 1/00*** | (2006.01) |
| *B22F 1/02* | (2006.01) |

(52) U.S. Cl.

CPC ..... *H01F 1/26* (2013.01); *B22F 1/0059* (2013.01); *B22F 1/02* (2013.01); *B22F 2001/0066* (2013.01); *B22F 2998/10* (2013.01); *B22F 2999/00* (2013.01); *C22C 2202/02* (2013.01)

(58) Field of Classification Search

CPC ... H01F 1/11; H01F 1/061; H01F 1/26; H01F 1/20; H01F 1/28; H01F 1/0054; H01F 27/255; B22F 1/0059; B22F 2301/35; B22F 2001/0066; C08L 71/12

USPC ..... 252/62.57, 62.63, 62.51 R, 62.53, 62.54, 252/62.55, 62.56, 62.59, 62.62

See application file for complete search history.

(56) References Cited

U.S. PATENT DOCUMENTS

| | | | | |
|---|---|---|---|---|
| 5,629,092 | A * | 5/1997 | Gay | H01F 1/0533 252/62.51 R |
| 2007/0252771 | A1 | 11/2007 | Maezawa et al. | |
| 2014/0158929 | A1* | 6/2014 | Oikawa | H01F 1/26 252/62.54 |
| 2015/0104664 | A1 | 4/2015 | Ikari et al. | |
| 2018/0151279 | A1 | 5/2018 | Ueyama et al. | |

FOREIGN PATENT DOCUMENTS

| | | | | |
|---|---|---|---|---|
| JP | H01-281705 | A | | 11/1989 |
| JP | 2003-318014 | A | | 11/2003 |
| JP | 2008-214665 | A | | 9/2008 |
| JP | 2009-105170 | A | | 5/2009 |
| JP | 2009-155545 | A | | 7/2009 |
| JP | 2009155545 | A | * | 7/2009 |
| JP | 2011-096923 | A | | 5/2011 |
| JP | 2013-077802 | A | | 4/2013 |
| JP | 2013-149854 | A | | 8/2013 |
| JP | 2013-236021 | A | | 11/2013 |
| JP | 2014-116332 | A | | 6/2014 |
| JP | 6552283 | B2 | | 7/2019 |
| TW | 200628062 | A | | 8/2006 |

OTHER PUBLICATIONS

Machine translation of JP-2009155545-A, 63 pages. (Year: 2009).*
International Search Report from PCT/JP2016/066148, dated Aug. 16, 2016.
International Preliminary Report on Patentability from PCT/JP2016/066148, dated Dec. 5, 2017.

* cited by examiner

*Primary Examiner* — Matthew E. Hoban
*Assistant Examiner* — Lynne Edmondson
(74) *Attorney, Agent, or Firm* — Greenblum & Bernstein, P.L.C.

(57) ABSTRACT

A magnetic compound having a small dielectric loss and an antenna constituted by the magnetic compound and an electronic device incorporating the antenna are provided by a metal magnetic powder which is well dispersed in a resin having small dielectric loss, and a magnetic powder composite including: a metal magnetic powder; and one or more elements selected from carboxylic acid or its anhydride, aromatic carboxylic acid ester, and a derivative thereof, having a property that real part μ' permeability is 1.45 or more, tan δμ is 0.1 or less, tan δε is 0.05 or less at a measuring frequency of 2 GHz, when a magnetic powder composite is prepared by adding 5 parts by mass of one or more elements selected from the carboxylic acid or its anhydride, the aromatic carboxylic acid ester, and the derivative thereof to 100 parts by mass of the metal magnetic powder.

7 Claims, No Drawings

MAGNETIC POWDER COMPOSITE, ANTENNA AND ELECTRONIC DEVICE, AND METHOD FOR PRODUCING THE SAME

TECHNICAL FIELD

The present invention relates to a magnetic powder composite, an antenna and an electronic device.

DESCRIPTION OF RELATED ART

In electronic devices and communication devices, various materials have been developed successfully to meet various functions of the market. Under this circumstance, in a device used for high-frequency regions and the like, a composite functional material affects the performance of a communication device, and therefore it is an important technical element.

For example, patent document 1 describes a magnetic composite material that also functions in the high frequency region. This magnetic composite material is formed by dispersing preferably, magnetic metal particles each having an acicular shape with an aspect ratio (long axis length/short axis length) of 1.5 to 20, for example, in a dielectric material such as polyarylene ether resin or polyethylene resin (see paragraph [0025], claims 1 and 2 of patent document 1).

By using the above constitution, the magnetic composite material is suitably used for high frequency electronic components to be installed in electronic devices and communication devices used in the high frequency region of the GHz band, and by using predetermined acicular metal particles, predetermined magnetic properties can be provided regardless of whether or not the magnetic metal particles are oriented in the dielectric material (see paragraphs [0024], [0029] of patent document 1).

Further, patent document 2 describes a composite magnetic material that can be used for a small antenna that can be used in a wide band. This composite magnetic material is dispersed in an insulating material. This composite magnetic material is a substantially spherical powder containing a soft magnetic metal, with its average particle diameter $D_{50}$ of 0.1 to 3 μm and, having a crystallite with an average crystallite diameter of 2 to 100 nm in the particle, and various resins are described as insulating materials (see paragraphs [0018] to [0021] of patent document 2).

For example, in the examples, an antenna is manufactured by mixing a magnetic powder, a thermoplastic PC/ABS resin, a solvent and the like (see paragraph [0069] of patent document 2). In this antenna, tan Sc at a frequency of 2 GHz is less than 0.01 and a volume ratio of the magnetic powder to the total volume is 2 to 50 vol %, so that miniaturization of the antenna is achieved (see paragraphs [0031] to [0032] of patent document 2).

Patent document 3 describes as follows: by using metal magnetic powder, a loss factor in the GHz band can be suppressed to be low. A soft magnetic metal powder containing iron as a main component, which is a metal powder having an average particle size of 100 nm or less, an axial ratio (=long axis length/short axis length) of 1.5 or more, a coercive force (Hc) of 39.8 to 198. 9 kA/m (500 to 2500 Oe) and saturation magnetization of 100 $Am^2/kg$ or more is molded, and a loss factor in the kHz to GHz band can be kept low (see paragraphs [0011] to [0026] of patent document 3).

Patent document 4 describes as follows: in a bonded magnet having heat resistance, a magnetic powder, a polyphenylene sulfide (PPS) resin, and a polyamide (PA) resin are contained, in which the content ratio of the magnetic powder in the magnetic composite is 79 to 94.5 wt %, the content ratio of the PPS resin is 5 to 20 wt %, and the content ratio of the PA resin is 0.1 to 2 wt % (see claim 1 of patent document 4).

As described above, there is a description about the magnetic composite (or also referred to as a "magnetic compound") containing a metal magnetic powder and a resin, but in the magnetic composite containing the metal magnetic powder and the resin, the metal magnetic powder is fine particles of an inorganic compound and the resin is a polymer compound. Namely, the metal magnetic powder and the resin have completely different chemical properties and physical properties, respectively. Therefore, it is difficult to predict what kind of performance the magnetic composite will be, and various trial and error studies are required as in the prior art.

PRIOR ART DOCUMENT

Patent document

[Patent Document 1] Japanese Unexamined Patent Publication No. 2014-116332
[Patent Document 2] Japanese Unexamined Patent Publication No. 2011-096923
[Patent Document 3] Japanese Unexamined Patent Application Publication No. 2013-236021
[Patent Document 4] Japanese Unexamined Patent Publication No. 2013-077802

SUMMARY OF THE INVENTION

Problem to be Solved by the Invention

The magnetic compound prepared by kneading a magnetic powder and a resin material or the like have been desired to improve their properties in accordance with a demand for higher performance of electronic devices, and on the other hand, improvement of mechanical strength is also demanded from a request for miniaturization.

Patent Documents 1 to 4 disclose a magnetic compound having a high magnetic powder content ratio. However, for example, by using the metal magnetic powder disclosed by the applicant in patent document 3 along with an improvement of the performance of the metal magnetic powder achieved by the examination of the applicant, sufficient high frequency properties have been obtained even if the content of the metal magnetic powder in the magnetic compound is reduced to some extent. However, when such a metal magnetic powder is dispersed in a resin, it has been found that ignition occurs in a kneading stage or remarkable decrease in strength occurs as compared with a case that the metal magnetic powder is not added. Namely, the magnetic compound material that satisfies both mechanical strength and high frequency properties has not yet been obtained.

For example, patent document 4 describes that other unexpected effect may occur during kneading and molding due to poor wettability between the PPS resin and the magnetic powder (see paragraphs [0008] and [0035] of patent document 4). Many resins with small dielectric loss are seen in the high frequency region, but even if simply kneading the metal magnetic powder and the resin to take only good points, it is confirmed that the magnetic compound with small dielectric loss is hardly obtained.

Therefore, an object of the present invention is to provide a metal magnetic powder that is well dispersed in a resin with small dielectric loss, and provide a magnetic compound having a small dielectric loss, and an antenna constituted by the magnetic compound, and an electronic device incorporating the antenna, and a method for manufacturing the same.

Means for Solving the Problem

According to a knowledge of the inventors of the present invention, when an antenna is constituted by a magnetic compound in which metal magnetic powder is mixed in resin, the antenna itself can be miniaturized due to wavelength shortening effect, thereby further contributing to miniaturization of portable devices and smartphones.

Conventionally, as typified by patent document 1, a material for a magnetic compound used for an antenna or the like is simply limited to studies on metal materials even though adopting a constitution in which the resin is mixed.

In contrast, inventors of the present invention achieve an epoch-making idea and carried out examination as follows: there are clues that can solve the abovementioned problem in how to improve a compatibility with the resin to be mixed with the metal magnetic powder instead of the metal magnetic powder alone which can express the properties.

First, as the resin that can be a candidate for mixing, the inventors of the present invention consider that selecting a material with excellent mechanical properties (especially bending strength) and a small loss of resin itself is a short cut. However, as described above, it is found that for example, even when the metal magnetic powder disclosed in patent document 3 is mixed with the resin that can become a candidate, burning is caused by ignition when the metal magnetic powder touches the atmosphere.

Further, as a method for mixing the resin, it is conceivable to increase the resin ratio so as to seal the metal magnetic powder with the resin to prevent ignition. However, as a matter of course, the content ratio of the metal magnetic powder is decreased and the permeability of the magnetic compound itself is decreased, so possibility is considered that the antenna does not operate sufficiently as an antenna.

Here, the inventors of the present invention have studied a method for mixing a magnetic powder into the resin, and it is found that by processing the metal magnetic powder into a magnetic powder composite, it becomes possible to mix with a desired resin.

A first aspect of the present invention is a magnetic powder composite; including:

a metal magnetic powder; and one or more elements selected from carboxylic acid or its anhydride, aromatic carboxylic acid ester, and a derivative thereof, having a property that real part μ' of permeability is 1.45 or more, tan δμ is 0.1 or less, tan δε is 0.05 or less at a measuring frequency of 2 GHz, when a magnetic powder composite prepared by adding 5 parts by mass of one or more elements selected from the carboxylic acid or its anhydride, the aromatic carboxylic acid ester, and the derivative thereof to 100 parts by mass of the metal magnetic powder, and 30 vol % of the magnetic powder composite is contained in a thermoplastic resin in which the tan δε is 0.05 or less at 1 MHz specified in IEC 60250 or JIS C 2138: 2007.

A second aspect of the present invention is a magnetic powder composite, wherein the thermoplastic resin is a resin containing an aromatic ring.

A third aspect of the present invention is a magnetic powder composite, including:

a metal magnetic powder; and one or more elements selected from carboxylic acid or its anhydride, aromatic carboxylic acid ester, and a derivative thereof, having a property that real part μ' of permeability is 1.45 or more, tan δμ is 0.1 or less, tan δε is 0.05 or less at a measuring frequency of 2 GHz, when a magnetic powder composite is prepared by adding 5 parts by mass of one or more elements selected from the carboxylic acid or its anhydride, the aromatic carboxylic acid ester, and the derivative thereof to 100 parts by mass of the metal magnetic powder, and 30 vol % of the magnetic powder composite is contained in a material containing one or more kinds of resins selected from SPS, m-PPE, and PPS.

A fourth aspect of the present invention is the magnetic powder composite of the first to third aspects, wherein the carboxylic acid is one or more elements selected from aromatic carboxylic acid or unsaturated carboxylic acid and dicarboxylic acid.

A fifth aspect of the present invention is the magnetic powder composite of any one of the first to fourth aspects, wherein the number of carbon atoms constituting any of the carboxylic acid or its anhydride, the aromatic carboxylic acid ester, and the derivative thereof is 4 to 30.

A sixth aspect of the present invention is the magnetic powder composite of any one of the first to fifth aspects, wherein the carboxylic acid or its anhydride, the aromatic carboxylic acid ester, and the derivative thereof are, one or more elements selected from phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate and a derivative thereof.

A seventh aspect of the present invention is a magnetic compound, including:

the magnetic powder composite of any one of the first to fifth aspects; and one or more kinds of resins selected from SPS and m-PPE.

An eighth aspect of the present invention is a magnetic compound, including:

the magnetic powder composite of the sixth aspect including one or more elements selected from maleic acid, maleic anhydride, succinic acid, succinic anhydride, malonic acid, fumaric acid, glutaric acid, azelaic acid, sebacic acid, benzoic acid and a derivative thereof, as the carboxylic acid or its anhydride, the aromatic carboxylic acid ester, and the derivative thereof; and PPS resin.

A ninth aspect of the present invention is an antenna constituted by the magnetic powder composite of any one of the first to sixth aspects.

A tenth aspect of the present invention is an electronic device including the antenna constituted by the magnetic powder composite of any one of the first to sixth aspects.

An eleventh aspect of the present invention is a method for producing a magnetic powder composite by mixing a metal magnetic powder, and one or more elements selected from carboxylic acid or its anhydride, aromatic carboxylic acid ester, and a derivative thereof.

A twelfth aspect of the present invention is the method for producing the magnetic powder composite of the eleventh aspect, wherein in the step of mixing the metal magnetic powder, and one of more elements selected from the carboxylic acid or its anhydride, the aromatic carboxylic acid ester, and the derivative thereof, a magnetic powder composite is produced by interposing a solution having a boiling point of 100° C. or less at 1 atmosphere.

Advantage of the Invention

According to the present invention, by providing a magnetic powder composite which is well dispersed in a resin having small dielectric loss, it is possible to provide a magnetic compound having a small dielectric loss and further an antenna constituted by the magnetic compound and an electronic device incorporating the antenna.

DETAILED DESCRIPTION OF THE INVENTION

Embodiments will be described hereafter in the following order.

<1. Magnetic Powder Composite for Constituting a Magnetic Compound>

1-1. Metal Magnetic Powder 1-2. Coating Material and Magnetic Powder Composite

<2. Method for Producing a Magnetic Compound>

2-1. Resin to be Used 2-2. Preparation Step 2-3. Coating Step (Surface Treatment)

2-4. Kneading Step with Resin

<3. Modified Example, etc>

In this specification, "to" means that it is a continuous range that is not less than a predetermined value and not more than a predetermined value.

<1. Magnetic Powder Composite for Constituting a Magnetic Compound>

The magnetic powder composite for constituting the magnetic compound in this embodiment, contains a metal magnetic powder, and one or more coating materials selected from carboxylic acid or an anhydride formed by dehydration in its molecule or dehydrating action of a plurality of carboxylic acids, aromatic carboxylic acid ester, and a derivative thereof.

Each constitution will be described hereafter.

1-1. Metal Magnetic Powder

An example of the metal magnetic powder in this embodiment has the following constitution.

Particles having appropriately designed magnetic properties, particle diameter, and the like may be used as the metal magnetic powder.

As the magnetic properties, permeability and dielectric constant of the magnetic compound can be set by saturation magnetization (σs). In addition, the particle diameter, shape, BET (specific surface area) and TAP (tap) density may be adjusted, and coercive force (Hc), squareness ratio (SQ), etc., as powder properties may be adjusted. For example, one or more elements selected from Fe (iron) or Fe and Co (cobalt), rare earth element (including Y (yttrium), hereinafter the same), Al (aluminum), Si (silicon), Mg (magnesium) hereinafter referred to as "Al, etc."), are contained in the metal magnetic powder of this embodiment.

In an aqueous solution containing an element which is a raw material of the metal magnetic powder, the axial ratio (=long axis length/short axis length) of finally obtained metal particles can be changed by changing an amount of a rare earth element including Y.

When the amount of the rare earth element is small, the axial ratio becomes large and a metal powder with low loss can be obtained, but permeability is reduced. In contrast, when the amount of the rare earth element is large, the axial ratio becomes small and the loss is increased somewhat, but the magnetic permeability becomes large compared to a case that the amount of the rare earth element is small.

Namely, by setting an appropriate rare earth content in the metal magnetic powder, lower loss and higher magnetic permeability can be obtained. As a result, it is possible to obtain the metal magnetic powder which can be used in a wide range such as the kHz band to the GHz band.

Here, as described above, a specific content range of a suitable element to maintain a balance of properties is as follows: the content of the rare earth element with respect to the sum of Fe and Co is preferably 0 at % (preferably more than 0 at %) to 10 at %, and more preferably more than 0 at % and 5 at % or less. Further, Y and La are preferable as rare earth element species.

When the metal magnetic powder contains Co, the Co content, is preferably 0 to 60 at % in the atomic ratio of Co to Fe (hereinafter referred to as "Co/Fe atomic ratio"). More preferably, the Co/Fe atomic ratio is 5 to 55 at %, and still more preferably 10 to 50 at %. In such a Co/Fe atomic ratio range, the metal magnetic powder has high saturation magnetization, and stable magnetic properties are easily obtained.

Further, Al or the like also has a sintering suppressing effect and it is possible to suppress the coarsening of the particles of the metal magnetic powder due to sintering during a heat treatment. In the present invention, Al or the like is treated as one of "sintering suppressing elements".

However, since Al or the like is a non-magnetic component, it is preferably contained within a range in which the magnetic properties of the metal magnetic powder can be secured. Specifically, the content of Al or the like with respect to the sum of Fe and Co is preferably 1 at % to 20 at %, more preferably 3 at % to 18 at %, and still more preferably 5 at % to 15 at %.

The metal magnetic powder in this embodiment preferably has a core/shell structure composed of a core made of a metal component and a shell mainly composed of an oxide component. Whether or not it has the core/shell structure can be confirmed by, for example, a TEM photograph, and for a composition analysis, methods such as ICP emission analysis, ESCA (aka XPS), TEM-EDX, SIMS and the like can be adopted.

An average primary particle size of the metal magnetic powder is preferably 10 nm or more and 500 nm or less (preferably 100 nm or less). Although the metal magnetic powder having a micro level (gm) size can be used, smaller particle size is desirable from a viewpoint of improving communication properties and miniaturization of a device.

Further, the content of the metal magnetic powder may be adjusted so that it is 50 vol % or less, preferably 40 vol % or less, and more preferably 35 vol % or less with respect to a predetermined resin (described later). This is because an elastic modulus can be improved without deteriorating a bending strength of the resin while obtaining desired excellent communication properties.

1-2. Coating Material and Magnetic Powder Composite

The coating material in this embodiment is formed on the surface of the metal magnetic powder in a surface treatment step described later, and becomes a magnetic powder composite. It is considered that the coating material adheres to at least a part of the surface of the metal magnetic powder to form a magnetic powder composite. The coating material is one or more elements selected from carboxylic acid or an anhydride formed by a dehydrating action in its molecule, aromatic carboxylic acid ester, and a derivative thereof. Here, the term "derivative" as used herein refers to a compound which has been modified to such an extent that it does not significantly alter a structure or properties of a parent body, the modification being introduction of functional groups, oxidation, reduction, and substitution of atoms, wherein "substitution of atoms" is based on a concept that a substance whose end is substituted with an alkali metal and which is made soluble.

As a result of investigation by the inventors of the present invention, it is found that among carboxylic acids, the carboxylic acid having a molecular weight of 500 or less is more preferable than polymers having a molecular weight of tens of thousands like resins. Further, the carbon number is preferably from 4 to 30. Specifically, among the carboxylic acid or the anhydrides thereof, the aromatic carboxylic acid ester, and the derivative thereof, phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate and their derivative are preferable, and phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate as a main skeleton while having a structure of 4 to 30 carbon atoms are further preferable.

The carboxylic acid and the derivative thereof are not necessarily used as a single kind, and use of plural kinds of carboxylic acids is not precluded.

When the number of carbon atoms falls within the above range, this is more suitable because the compatibility between the resin and the magnetic powder composite is further improved. The term "anhydride" as used herein refers to a compound (phthalic acid and phthalic anhydride) formed by removal (intramolecular dehydration) of a water molecule from a compound by heating or the like, including a compound in which two oxoacids were dehydrated and condensed (relationship between benzoic acid and benzoic anhydride).

An amount of the coating material in the magnetic powder composite in which the surface of the metal magnetic powder is coated with the coating material is preferably that a carbon measured value by a high frequency combustion method is 0.1 mass % or more and 10 mass % or less in the magnetic powder composite.

<2. Method for Producing the Magnetic Compound>

A method for producing the magnetic compound will be described hereafter.

2-1. Resin to be Used

The resin suitable as the resin in this embodiment is a thermoplastic resin in which a tan $\delta\varepsilon$ is 0.05 or less at 1 MHz specified in IEC 60250 or JIS C 2138: 2007. By using such a resin, the effect of this embodiment can be obtained. Particularly, when the thermoplastic resin having an aromatic ring is used, tan $\delta\varepsilon$ is satisfactory, which is preferable, and particularly, it is preferable to use one or more kinds of resins selected from SPS (syndiotactic polystyrene), PPS (polyphenylene sulfide), and m-PPE (modified polyphenylene ether).

As will be described later in the items of examples, one or more kinds of resins selected from PPS, SPS and m-PPE is adopted as a resin, and the resin is kneaded with the magnetic powder composite of the present invention, so that the magnetic compound of the present invention can be produced.

As a magnetic property in a high frequency (2 GHz) region of a molded body given by the magnetic compound according to the present invention (the composition of the metal magnetic powder in the composite: corresponding to 30% by volume), it is preferable that the real part $\mu'$ of the complex relative magnetic permeability is 1.450 or more, preferably 1.50 or more, and more preferably 1.70 or more. The magnetic compound having such properties has a high magnetic permeability, and therefore it can exhibit a sufficient miniaturization effect, and it is very useful for constituting an antenna with small return loss.

Further, regarding the magnetic loss of the molded body formed by the magnetic compound according to the present invention, it is preferable that tan $\delta\mu$ is 0.1 or less, tan $\delta\varepsilon$ is 0.05 or less at a measuring frequency of 2 GHz, when a magnetic powder composite is prepared by adding 5 parts by mass of one or more elements selected from the carboxylic acid or its anhydride, aromatic carboxylic acid ester, and the derivative thereof, to 100 parts by mass of the metal magnetic powder, and 30% by volume of the magnetic powder composite is contained in the thermoplastic resin or one or more kinds of resins selected from SPS, m-PPE, PPS, and the like, to make a magnetic compound.

2-2. Preparation Step

In this step, various preparations are performed for producing the magnetic compound. For example, various raw materials such as the abovementioned metal magnetic powder, a raw material of the coating material, and resin to be mixed are prepared.

2-3. Coating Step (Surface Treatment)

By adding a predetermined organic compound (one or more elements selected from the carboxylic acid, the carboxylic acid anhydride, the aromatic carboxylic acid ester and the derivative thereof) to the metal magnetic powder and applying surface treatment thereto, a magnetic powder composite is obtained. Among carboxylic acids, carboxylic acid having a molecular weight of 500 or less is more preferable than polymers having a molecular weight of tens of thousands like resins. Further, the number of carbon atoms is preferably 4 to 30. Specifically, among the carboxylic acid or the anhydrides thereof, the aromatic carboxylic acid ester, and the derivative thereof, phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate and their derivative are preferable, and phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate as a main skeleton while having a structure of 4 to 30 carbon atoms are further preferable.

These carboxylic acids, carboxylic acid anhydrides, aromatic carboxylic acid esters, and their derivative are not necessarily used as a single kind, and use of plural kinds of carboxylic acid, carboxylic acid anhydride, aromatic carboxylic acid ester, and the derivative thereof is not precluded.

Further, when the carbon content of the organic compound is 0.1 mass % or more in the magnetic powder composite, the dispersion of the magnetic powder composite in the resin can be suitably performed, which is preferable. In contrast, when the carbon content is 10 mass % or less, a nonmagnetic component does not become excessive, the magnetic permeability is not decreased when forming the magnetic powder composite or the magnetic compound to be formed thereafter, which is preferable.

Specifically, in the magnetic powder composite, the addition amount of the organic compound is 2 to 15, more preferably 2.5 to 10, and still more preferably 5 to 10 with respect to the metal magnetic powder 100 in mass ratio.

When the mass ratio is 2 or more, there is compatibility between the metal magnetic powder and the resin, and therefore property stability of the product at the time of production is improved. When the mass ratio is 15 or less, the nonmagnetic component in the metal magnetic powder becomes an appropriate amount, and it is possible to suppress deterioration of the magnetic properties of the magnetic powder composite itself constituted by the metal magnetic powder coated with the coating material. As a result, high-frequency property can be maintained at a relatively high level when the magnetic powder composite is mixed into the resin to form a magnetic compound, and the properties of the finally formed antenna can be kept relatively high as well.

Details are unknown regarding a mechanism why the organic compound improves "wettability" between the surface-treated metal magnetic powder and the resin, and therefore although it is only inferring, the carboxyl group side is attracted to the surface of the metal magnetic powder while the opposite side (the side without the carboxyl group) becomes compatible with the hydrophobic resin side in view of the structural formula of the organic compound, and as a result, it seems that there is the compatibility between the metal magnetic powder and the resin. Further, although the metal magnetic powder and a predetermined organic compound are mixed and part of it is coated with the magnetic powder, the organic compound in a free state "not used for coating" is remained in the metal magnetic powder without being removed so as to be kept intact, and it is presumed that some dispersing action is also generated in addition to the abovementioned "wettability" action.

During the surface treatment, it is preferable to add a predetermined solvent (a liquid to be added for improving compatibility between the powder and the coating material). Particularly, when a solvent having a boiling point of 100° C. or less at 1 atm is added, it is possible to improve the compatibility between the metal magnetic powder and the carboxylic acid or its anhydride, the aromatic carboxylic acid ester, and the derivative thereof. By selecting the solvent having a boiling point of 100° C. or less to be added, the added solvent can be removed even by a slight heating. As the predetermined solvent, various alcohols, hydrocarbon solvents, ketones, ethers and the like can be used, and it is not necessary that the abovementioned carboxylic acid or its anhydride, aromatic carboxylic acid ester, and their derivative organic compounds are completely dissolved.

Specifically, ethanol, methanol, propanol, IPA, hexane, acetone, butanone and the like can be given, but the present invention is not limited thereto. As a particularly preferred embodiment, alcohols can be given, and particularly, it is preferable to use ethanol from a viewpoint of ease of handling.

Therefore, in order to obtain a dried magnetic powder composite, it is convenient to adopt a method of adding a metal magnetic powder to the abovementioned organic compound plus the solvent to impregnate the metal magnetic powder into the solvent and then removing the solvent.

Further, in order to produce the magnetic powder composite, it is also preferable to adopt a method of adding the metal magnetic powder to the abovementioned solution of the organic compound, and stirring it with a rotation/revolution combination type stirrer or stirring while adding a shearing force, to thereby form a paste. Through a pasting process, the abovementioned organic compound and the metal magnetic powder are well mixed, with excellent compatibility between them. Thereby, the organic compound is more easily adsorbed on the surface of the metal magnetic powder, and it becomes easy to form the magnetic powder composite.

Namely, there is no problem as long as the organic compound evenly added to the metal magnetic powder is evenly spread. In addition, there is no problem in using a mixer or the like for removing and drying the solvent during kneading. After removing and drying the solvent, it is essential that the organic compound is remained on the surface of the particle of the metal magnetic powder.

Further, in order to produce the magnetic powder composite, it is necessary to form the coating material while efficiently generating contact between the metal magnetic powder and the organic compound, and therefore a disperser and a kneader having a high shearing force may be used, or it is also acceptable to adopt a method for dispersing the metal magnetic powder in the solvent while adding a strong shearing force to the solvent.

As the disperser having a strong shearing force which is used when adopting a method for drying the magnetic powder composite in a powder state after production, T. K. Homomixer (registered trademark) known as a turbine-stator type stirrer manufactured by Primix Corporation, and Ultra-Turrax (registered trademark) manufactured by IKA Corporation, etc., can be exemplified, and as the colloid mill, T. K. Mycolloider (registered trademark), T. K. Homomic line mill (registered trademark), and T. K. High line mill (registered trademark) manufactured by Primics Corporation, and Static mixer (registered trademark), high pressure microreactor (registered trademark), and high pressure homogenizer (registered trademark), etc., manufactured by NORITAKE COMPANY LIMITED, can be preferably exemplified.

The strength of the shearing force can be evaluated by a blade circumferential speed of a stirring blade, in a case of an apparatus having a stirring blade. In this embodiment, "Strong shearing force" means that the blade circumferential speed is preferably in a range of 3.0 (m/s) or more, and more preferably 5.0 (m/s) or more. When the blade circumferential speed is the above value or more, the shearing force is moderately high, the time for preparing the magnetic powder composite can be shortened, and the production efficiency is moderately good. However, when reduction of damage to the metal magnetic powder is taken into consideration, it is also possible to reduce the damage by adjusting the blade circumferential speed to be low.

The blade circumferential speed can be calculated by the following formula: circular constant×diameter of turbine blade (m)×stirring rotation number per second (rotation number). For example, if a diameter of the turbine blade is 3.0 cm (0.03 m) and the stirring rotation number is 8000 rpm, the stirring rotation number per second is 133.3 (rps), and the blade circumferential speed is 12.57 (m/s).

It is preferable to remove the solvent by drying the obtained paste-like magnetic powder composite. At this time, the paste can be spread on a vat and dried at a temperature equal to or higher than a drying temperature of the solvent and lower than a decomposition temperature of a coating material. For example, when a coating process is performed to a substance that is easily oxidized, drying of the solvent can be performed under an inert atmosphere or in a nitrogen atmosphere in view of a cost.

Here, when the surface treatment is carried out using an organic compound which can be strongly coated on the metal magnetic powder, for example, it is preferable to adopt a method of removing a certain amount of solvent by performing filtration, and thereafter performing drying. Thus, the content of the solvent can be reduced in advance, and the drying time can also be shortened. In order to confirm whether the coating is firm or not, for example, it is possible to evaluate how much a residual component is remained, by evaporating the filtrate.

On the other hand, in a case of adopting a method of adding the metal powder and performing surface treatment while stirring and mixing the solvent and the organic compound which is supposed to be deposited on the solvent, after mixing them without forming a paste, FM mixer manufactured by Nippon Coke Co., Ltd., and Super Mixer manufactured by Kawata Co., Ltd. can be used. Further, when such a device is accompanied by a heating device for evaporating the solvent, it is not necessary to take out the treated powder and subject it to drying, which is preferable.

When such a treatment is performed, it is preferable to perform treatment under an inert atmosphere for the purpose of suppressing deterioration of properties due to oxidation of the metal magnetic powder. Further, it is more preferable to perform an operation of aerating the inert gas (nitrogen in terms of a cost) into a liquid in which the solvent and the organic compound are once mixed. After the inside of a processing vessel is substituted with an inert gas, the metal magnetic powder is added so as not to be oxidized, and the solvent, the organic compound, and the metal magnetic powder are mixed to prepare a mixture, and thereafter, the mixture can be dried by setting a heating temperature to be equal to or higher than a drying temperature of the solvent and lower than the decomposition temperature of the coating material. In order to perform drying in a shorter time, it is preferable to operate the mixer and dry the mixture while rolling the mixture.

In the thus obtained aggregate of the magnetic powder composite having a coating material formed on its surface, it is preferable to remove coarse particles using a classifier or a sieve. This is because by removing excessively large coarse particles, it is preferably possible to avoid a situation in which a force is added on a certain portion of the coarse particles at the time of preparing the antenna, thereby deteriorating mechanical properties. When classifying is performed using a sieve, it is preferable to use a mesh with an opening of 500 mesh or less.

The properties and the composition of the magnetic powder composite obtained through the above steps are confirmed by the following method.

(BET Specific Surface Area)

A BET specific surface area is obtained by a BET one-point method using 4 SOURVE US manufactured by Yuasa Ionics Co., Ltd.

(Evaluation of Magnetic Properties of the Magnetic Powder Composite)

As magnetic properties (bulk properties) of the obtained magnetic powder composite (or metal magnetic powder), coercive force Hc (Oe or kA/m), saturation magnetization σs (Am 2/kg), squareness ratio SQ, and coercive force distribution SFD can be measured in an external magnetic field of 10 kOe (795.8 kA/m), using a VSM apparatus (VSM-7P) manufactured by Toei Industry Co., Ltd. Δσs is a percentage (%) of a reduction rate of the saturation magnetization when the magnetic powder is allowed to stand in a hot and humid environment of 60° C. and 90% for one week.

(Measurement of TAP Density)

TAP density can be measured by a method described in the specification of JP-A-2007-263860. Further, a method of JIS K-5101: 1991 may be adopted.

2-4. Kneading Step with Resin

The obtained magnetic powder composite and the abovementioned resin are melt-kneaded to thereby form a magnetic compound. The metal magnetic powder is in a dispersed state in the resin by the kneading step. In a state after kneading, it is desirable that the magnetic powder composite is dispersed in the resin with a uniform concentration. When the amount of the magnetic powder composite that can be mixed in the resin is large, the magnetic permeability becomes particularly high when high frequency is added thereto, and on the other hand, mechanical properties of the resin are deteriorated. Therefore, it is preferable to consider an addition amount of the magnetic powder composite in consideration of a balance between the mechanical properties and the high frequency properties of the magnetic compound.

The method for preparing the magnetic compound in this embodiment is not particularly limited. For example, kneading strength and the like may be adjusted using a commercially available kneader.

It is acceptable to adopt a method of preparing the magnetic compound by heating a mixture containing the resin, the metal magnetic powder, and the abovementioned organic compound, or it is also acceptable to adopt a method of adding the magnetic powder composite to a melted resin.

A melting temperature of the resin is usually higher than the melting temperature of the resin, and when the decomposability of the resin is high, the temperature is set at a decomposition temperature or lower.

Further, in order to improve a mechanical strength and the like of the resin, fibrous glass fiber, carbon fiber, graphite fiber, aramid fiber, vinylon fiber, polyamide fiber, polyester fiber, hemp fiber, kenaf fiber, bamboo fiber, steel fiber, cotton, rayon, aluminum fiber, carbon nanofiber, carbon nanotube, cotton fibril, silicon nitride whisker, alumina whisker, silicon carbide whisker, nickel whisker, talc which is tabular, kaolin clay, mica, glass flake, aragonite, calcium sulfate, aluminum hydroxide, organized montmorillonite, swellable synthetic mica, graphite, granular calcium carbonate, silica, glass beads, titanium oxide, zinc oxide, wollastonite, vermiculite, shirasu balloon, glass balloon, nano titanium oxide, nanosilica, and carbon black, etc., which are usually known as additives, can be added. In addition, a time-dependent deterioration suppressing substance may be added as long as the property as an antenna is not deteriorated by addition.

(Property Evaluation of the Magnetic Compound)

0.2 g of the magnetic compound obtained by the abovementioned method is placed in a donut-shaped container, and a molded body of a magnetic compound having an outer diameter of 7 mm and an inner diameter of 3 mm and having a toroidal shape is formed, using a hand press machine or a hot press machine. Thereafter, a network analyzer (E8362C) manufactured by Agilent Technologies, Ltd. and Coaxial S parameter method sample holder kit manufactured by Kanto Electronic Applied Development Co., Ltd. (product model number: CSH 2-APC 7, sample size: φ 7.0 mm−φ 3.04 mm×5 mm) are used, to thereby measure the high-frequency properties of the molded product of the obtained magnetic compound at intervals of 0.5 to 5 GHz, with a measurement width at intervals of 0.05 GHz, and by measuring the real part (μ') of permeability, the imaginary part (μ") of permeability, the real part (ε') of dielectric constant and the imaginary part (ε") of dielectric constant, the high frequency properties can be confirmed. Wherein, calculation is performed, based on tan δε=ε"/ε', and tan δμ=μ"/μ'.

As described above, according to this embodiment, it is possible to provide the magnetic compound excellent in high frequency properties and excellent in mechanical strength and related materials thereof, using any one of the resins such as SPS (syndiotactic polystyrene), PPS (polyphenylene sulfide), and m-PPE (modified polyphenylene ether).

<3. Modified Example, etc.>

The technical scope of the present invention is not limited to the abovementioned embodiments and includes various modifications and improvements within the scope of deriving specific effects obtained by the constituent features of the invention and combinations thereof.

(Metal Magnetic Particles, Coating Material, Magnetic Powder Composite and Resin)

In this embodiment, main metal elements and compounds have been described in detail with regard to the metal magnetic particles, the coating material, the magnetic powder composite, and the resin. On the other hand, the metal magnetic particle, the coating material, the magnetic powder composite and the resin may contain substances and elements other than those described above.

(Application)

The magnetic compound composed of the obtained magnetic powder composite and the specific resin in this embodiment, can be used for an antenna, an inductor, and a radio wave shielding material. Particularly, in the antenna composed of the magnetic compound, and further, in an electronic communication device (electronic device) including the antenna, it is possible to obtain relatively high communication properties as shown in the items of the embodiments described later. Namely, the magnetic compound according to this embodiment can be processed into electronic parts, antennas, electronic devices and the like as described above.

As such an electronic communication device, for example, a device having a unit that functions as an electronic communication device based on radio waves received by the antenna in this embodiment, and a control unit for controlling a relevant portion based on the received radio wave, can be given.

The electronic communication device in this embodiment is preferably a communication device having a communication function in view of having the antenna. However, an electronic device that does not have a communication function such as calling may be used as long as it is an electronic device that receives a radio wave by an antenna and exercises its function.

EXAMPLES

The present invention will be specifically described hereafter, with reference to examples. It is a matter of course that the present invention is not limited to the following examples.

Conditions and measurement results in each example listed in this item are described in tables 1 to 5.

Table 1 describes the raw materials of the samples according to examples 1 to 20 and comparative examples 1 to 6.

Table 2 describes magnetic properties and mechanical properties of the samples according to examples 1 to 20 and comparative examples 1 to 6.

Table 3 describes high frequency properties (750 MHz to 1 GHz, 2 GHz) of the samples according to examples 1 to 20 and comparative examples 1 to 6.

Table 4 describes high frequency properties (800 MHz, 1.5 GHz) of the samples according to examples 1 to 20 and comparative examples 1 to 6.

Table 5 describes high frequency properties (2.5 GHz, 3.0 GHz) of the samples according to examples 1 to 20 and comparative examples 1 to 6.

TABLE 1

| | Maleic acid Coating material | Resin | Metal magnetic powder (vol %) | Glass fiber (mass %) |
|---|---|---|---|---|
| Example 1 | Phthalic acid | PPS | 30 | 0 |
| Example 2 | Maleic anhydride | PPS | 30 | 0 |
| Example 3 | Maleic acid | PPS | 30 | 0 |
| Example 4 | Dimethyl phthalate | PPS | 30 | 0 |
| Example 5 | Succinic acid | PPS | 30 | 0 |
| Example 6 | Succinic anhydride | PPS | 30 | 0 |
| Example 7 | Phthalic anhydride | PPS | 30 | 0 |
| Example 8 | Benzoic acid | PPS | 30 | 0 |
| Example 9 | Malonic acid | PPS | 30 | 0 |
| Example 10 | Fumaric acid | PPS | 30 | 0 |
| Example 11 | Glutaric acid | PPS | 30 | 0 |
| Example 12 | Azelaic acid | PPS | 30 | 0 |
| Example 13 | Sebacic acid | PPS | 30 | 0 |
| Example 14 | Phthalic acid | PPS | 30 | 0 |
| Example 15 | Phthalic acid | PPS | 30 | 30 |
| Example 16 | Phthalic acid | SPS | 20 | 0 |
| Example 17 | Phthalic acid | SPS | 30 | 0 |
| Example 18 | Phthalic acid | SPS | 40 | 0 |
| Example 19 | Phthalic acid | PPE | 30 | 0 |
| Example 20 | Phthalic acid | PPE | 30 | 30 |
| Comparative example 1 | None | Epoxy | 30 | 0 |
| Comparative example 2 | Phthalic acid | Epoxy | 30 | 0 |
| Comparative example 3 | None | PPS | 30 | 0 |
| Comparative example 4 | None | SPS | 30 | 0 |
| Comparative example 5 | None | PPE | 30 | 0 |
| Comparative example 6 | None | PPS/PA6T | 30 | 0 |

TABLE 2

| | Hc (Oe) | Hc (kA/m) | σs ($Am^2/kg$) | SQ (—) | SFD (—) | Δσs (%) | BET ($m^2/g$) | TAP (g/cc) | Bending strength (Mpa) | Elastic modulus (Mpa) |
|---|---|---|---|---|---|---|---|---|---|---|
| Example 1 | 697 | 55.5 | 173.8 | 0.318 | 3.333 | 6.4 | 33.3 | 1.574 | 55.8 | 6021 |
| Example 2 | 703 | 55.9 | 171.7 | 0.319 | 3.313 | 8.7 | 31.3 | 1.517 | 80.6 | 6415 |
| Example 3 | 696 | 55.4 | 172.2 | 0.310 | 3.409 | 9.7 | 31.1 | 1.537 | 83.5 | 6533 |
| Example 4 | 698 | 55.5 | 173.4 | 0.312 | 3.355 | 4.8 | 33.5 | 1.535 | 62.4 | 5832 |
| Example 5 | 702 | 55.9 | 172.6 | 0.319 | 3.310 | 9.9 | 32.1 | 1.44 | 60.0 | 7352 |
| Example 6 | 704 | 56.0 | 173.8 | 0.315 | 3.329 | 8.4 | 33.4 | 1.605 | 71.8 | 7403 |
| Example 7 | 695 | 55.3 | 173 | 0.311 | 3.369 | 5.4 | 28.2 | 1.558 | 51.8 | 5929 |
| Example 8 | 687 | 54.7 | 174.9 | 0.304 | 3.450 | 4.8 | 29.3 | 1.702 | 56.7 | 5632 |
| Example 9 | 707 | 56.3 | 173.1 | 0.326 | 3.281 | 10.7 | 32.1 | 1.365 | 57.6 | 6523 |
| Example 10 | 716 | 57.0 | 170.900 | 0.325 | 3.249 | 9.0 | 36.2 | 1.37 | 69.4 | 5837 |
| Example 11 | 721 | 57.4 | 173.8 | 0.324 | 3.277 | 7.4 | 30.4 | 1.374 | 47.5 | 6533 |
| Example 12 | 708 | 56.3 | 174.7 | 0.328 | 3.249 | 5.1 | 28.8 | 1.368 | 60.1 | 5355 |
| Example 13 | 703 | 55.9 | 174.7 | 0.321 | 3.319 | 4.9 | 28.8 | 1.408 | 67.7 | 5714 |
| Example 14 | 724 | 57.6 | 173.5 | 0.322 | 3.268 | 5.7 | 34.9 | 1.373 | 50.0 | 5529 |
| Example 15 | 724 | 57.6 | 173.5 | 0.322 | 3.268 | 5.7 | 34.9 | 1.373 | 77.8 | 10527 |

TABLE 2-continued

| | Hc (Oe) | Hc (kA/m) | σs ($Am^2/kg$) | SQ (—) | SFD (—) | Δσs (%) | BET ($m^2/g$) | TAP (g/cc) | Bending strength (Mpa) | Elastic modulus (Mpa) |
|---|---|---|---|---|---|---|---|---|---|---|
| Example 16 | 724 | 57.6 | 173.5 | 0.322 | 3.268 | 5.7 | 34.9 | 1.373 | 43.3 | 3400 |
| Example 17 | 724 | 57.6 | 173.5 | 0.322 | 3.268 | 5.7 | 34.9 | 1.373 | 38.6 | 3952 |
| Example 18 | 724 | 57.6 | 173.5 | 0.322 | 3.268 | 5.7 | 34.9 | 1.373 | 35.0 | 5642 |
| Example 19 | 724 | 57.6 | 173.5 | 0.322 | 3.268 | 5.7 | 34.9 | 1.373 | 39.1 | 4424 |
| Example 20 | 724 | 57.6 | 173.5 | 0.322 | 3.268 | 5.7 | 34.9 | 1.373 | 60.6 | 7721 |
| Comparative example 1 | 757 | 60.2 | 179.3 | 0.337 | 3.141 | 7.6 | 37.3 | 1.093 | — | — |
| Comparative example 2 | 724 | 57.6 | 173.5 | 0.322 | 3.268 | 5.7 | 34.9 | 1.373 | — | — |
| Comparative example 3 | 757 | 60.2 | 179.3 | 0.337 | 3.141 | 7.6 | 37.3 | 1.093 | — | — |
| Comparative example 4 | 757 | 60.2 | 179.3 | 0.337 | 3.141 | 7.6 | 37.3 | 1.093 | — | — |
| Comparative example 5 | 757 | 60.2 | 179.3 | 0.337 | 3.141 | 7.6 | 37.3 | 1.093 | — | — |
| Comparative example 6 | 757 | 60.2 | 179.3 | 0.337 | 3.141 | 7.6 | 37.3 | 1.093 | — | — |

TABLE 3

| | 750 MHz~1 GHz | | | | | | | | | |
|---|---|---|---|---|---|---|---|---|---|---|
| | μ' | | ε' | | | | | | | |
| | Average | Standard deviation | Average | Standard deviation | 2.0 GHz | | | | | |
| | | | | | μ' | μ'' | tanδμ | ε' | ε'' | tanδε |
| Example 1 | 1.739 | 0.002 | 6.066 | 0.001 | 1.786 | 0.062 | 0.034 | 6.074 | 0.061 | 0.010 |
| Example 2 | 1.738 | 0.003 | 6.190 | 0.002 | 1.786 | 0.059 | 0.033 | 6.184 | 0.089 | 0.014 |
| Example 3 | 1.776 | 0.002 | 6.376 | 0.002 | 1.826 | 0.064 | 0.035 | 6.361 | 0.099 | 0.016 |
| Example 4 | 1.747 | 0.003 | 6.108 | 0.002 | 1.794 | 0.056 | 0.031 | 6.111 | 0.066 | 0.011 |
| Example 5 | 1.854 | 0.004 | 6.696 | 0.007 | 1.912 | 0.088 | 0.046 | 6.658 | 0.146 | 0.022 |
| Example 6 | 1.825 | 0.003 | 6.718 | 0.009 | 1.878 | 0.079 | 0.042 | 6.657 | 0.190 | 0.028 |
| Example 7 | 1.724 | 0.002 | 5.930 | 0.002 | 1.770 | 0.058 | 0.032 | 5.937 | 0.054 | 0.009 |
| Example 8 | 1.731 | 0.002 | 6.310 | 0.007 | 1.776 | 0.054 | 0.030 | 6.261 | 0.148 | 0.024 |
| Example 9 | 1.720 | 0.005 | 6.405 | 0.007 | 1.756 | 0.068 | 0.039 | 6.363 | 0.138 | 0.022 |
| Example 10 | 1.774 | 0.003 | 6.028 | 0.004 | 1.821 | 0.088 | 0.048 | 6.013 | 0.095 | 0.016 |
| Example 11 | 1.823 | 0.004 | 6.452 | 0.009 | 1.880 | 0.082 | 0.043 | 6.392 | 0.176 | 0.028 |
| Example 12 | 1.809 | 0.008 | 6.075 | 0.008 | 1.857 | 0.093 | 0.050 | 6.044 | 0.124 | 0.021 |
| Example 13 | 1.838 | 0.002 | 6.259 | 0.010 | 1.894 | 0.081 | 0.043 | 6.178 | 0.203 | 0.033 |
| Example 14 | 1.730 | 0.003 | 5.364 | 0.004 | 1.776 | 0.052 | 0.029 | 5.364 | 0.052 | 0.010 |
| Example 15 | 1.749 | 0.002 | 5.921 | 0.001 | 1.793 | 0.057 | 0.032 | 5.926 | 0.059 | 0.010 |
| Example 16 | 1.436 | 0.001 | 3.983 | 0.001 | 1.459 | 0.033 | 0.022 | 3.989 | 0.031 | 0.008 |
| Example 17 | 1.676 | 0.003 | 5.291 | 0.001 | 1.718 | 0.052 | 0.030 | 5.293 | 0.055 | 0.010 |
| Example 18 | 1.836 | 0.003 | 5.877 | 0.001 | 1.888 | 0.072 | 0.038 | 5.883 | 0.055 | 0.009 |
| Example 19 | 1.730 | 0.003 | 5.364 | 0.004 | 1.776 | 0.052 | 0.029 | 5.364 | 0.052 | 0.010 |
| Example 20 | 1.749 | 0.002 | 5.921 | 0.001 | 1.793 | 0.057 | 0.032 | 5.926 | 0.059 | 0.010 |
| Comparative example 1 | 1.859 | 0.005 | 6.710 | 0.039 | 1.916 | 0.113 | 0.059 | 6.466 | 0.470 | 0.073 |
| Comparative example 2 | 1.921 | 0.005 | 7.848 | 0.057 | 1.980 | 0.120 | 0.060 | 7.494 | 0.664 | 0.089 |
| Comparative example 3 | — | — | — | — | — | — | — | — | — | — |
| Comparative example 4 | — | — | — | — | — | — | — | — | — | — |
| Comparative example 5 | — | — | — | — | — | — | — | — | — | — |
| Comparative example 6 | — | — | — | — | — | — | — | — | — | — |

TABLE 4

| | 800 MHz | | | | | | 1.5 GHz | | | | | |
|---|---|---|---|---|---|---|---|---|---|---|---|---|
| | μ' | μ'' | tanδμ | ε' | ε'' | tanδε | μ' | μ'' | tanδμ | ε' | ε'' | tanδε |
| Example 1 | 1.738 | 0.015 | 0.009 | 6.064 | 0.029 | 0.005 | 1.763 | 0.034 | 0.019 | 6.069 | 0.040 | 0.007 |
| Example 2 | 1.736 | 0.012 | 0.007 | 6.189 | 0.059 | 0.010 | 1.762 | 0.029 | 0.016 | 6.184 | 0.070 | 0.011 |
| Example 3 | 1.776 | 0.015 | 0.008 | 6.377 | 0.063 | 0.010 | 1.802 | 0.035 | 0.020 | 6.365 | 0.079 | 0.012 |
| Example 4 | 1.745 | 0.011 | 0.006 | 6.106 | 0.029 | 0.005 | 1.771 | 0.031 | 0.017 | 6.108 | 0.043 | 0.007 |

TABLE 4-continued

| | 800 MHz | | | | | | 1.5 GHz | | | | | |
|---|---|---|---|---|---|---|---|---|---|---|---|---|
| | μ' | μ'' | tanδμ | ε' | ε'' | tanδε | μ' | μ'' | tanδμ | ε' | ε'' | tanδε |
| Example 5 | 1.850 | 0.018 | 0.010 | 6.700 | 0.126 | 0.019 | 1.886 | 0.045 | 0.024 | 6.670 | 0.129 | 0.019 |
| Example 6 | 1.823 | 0.017 | 0.010 | 6.724 | 0.171 | 0.025 | 1.854 | 0.042 | 0.023 | 6.675 | 0.173 | 0.026 |
| Example 7 | 1.725 | 0.014 | 0.008 | 5.926 | 0.017 | 0.003 | 1.748 | 0.031 | 0.018 | 5.935 | 0.034 | 0.006 |
| Example 8 | 1.732 | 0.015 | 0.008 | 6.311 | 0.125 | 0.020 | 1.755 | 0.033 | 0.019 | 6.275 | 0.132 | 0.021 |
| Example 9 | 1.719 | 0.034 | 0.020 | 6.411 | 0.121 | 0.019 | 1.747 | 0.044 | 0.025 | 6.377 | 0.123 | 0.019 |
| Example 10 | 1.773 | 0.037 | 0.021 | 6.025 | 0.056 | 0.009 | 1.801 | 0.059 | 0.033 | 6.020 | 0.066 | 0.011 |
| Example 11 | 1.822 | 0.017 | 0.009 | 6.456 | 0.154 | 0.024 | 1.856 | 0.043 | 0.023 | 6.411 | 0.160 | 0.025 |
| Example 12 | 1.809 | 0.036 | 0.020 | 6.076 | 0.104 | 0.017 | 1.839 | 0.053 | 0.029 | 6.050 | 0.105 | 0.017 |
| Example 13 | 1.835 | 0.017 | 0.009 | 6.267 | 0.193 | 0.031 | 1.869 | 0.038 | 0.020 | 6.204 | 0.194 | 0.031 |
| Example 14 | 1.700 | 0.027 | 0.016 | 5.987 | 0.036 | 0.006 | 1.725 | 0.037 | 0.021 | 5.984 | 0.048 | 0.008 |
| Example 15 | 1.854 | 0.018 | 0.010 | 6.959 | 0.061 | 0.009 | 1.890 | 0.043 | 0.022 | 6.947 | 0.073 | 0.010 |
| Example 16 | 1.436 | 0.018 | 0.013 | 3.983 | 0.007 | 0.002 | 1.448 | 0.023 | 0.016 | 3.986 | 0.015 | 0.004 |
| Example 17 | 1.676 | 0.024 | 0.014 | 5.291 | 0.025 | 0.005 | 1.700 | 0.032 | 0.019 | 5.290 | 0.034 | 0.006 |
| Example 18 | 1.834 | 0.025 | 0.013 | 5.877 | 0.020 | 0.003 | 1.865 | 0.042 | 0.022 | 5.878 | 0.033 | 0.006 |
| Example 19 | 1.734 | 0.023 | 0.013 | 5.359 | 0.023 | 0.004 | 1.755 | 0.033 | 0.019 | 5.362 | 0.033 | 0.006 |
| Example 20 | 1.747 | 0.018 | 0.011 | 5.922 | 0.026 | 0.004 | 1.769 | 0.034 | 0.019 | 5.926 | 0.038 | 0.006 |
| Comparative example 1 | 1.858 | 0.052 | 0.028 | 6.726 | 0.470 | 0.070 | 1.896 | 0.070 | 0.037 | 6.542 | 0.461 | 0.070 |
| Comparative example 2 | 1.920 | 0.044 | 0.023 | 7.872 | 0.688 | 0.087 | 1.958 | 0.073 | 0.037 | 7.604 | 0.660 | 0.087 |
| Comparative example 3 | — | — | — | — | — | — | — | — | — | — | — | — |
| Comparative example 4 | — | — | — | — | — | — | — | — | — | — | — | — |
| Comparative example 5 | — | — | — | — | — | — | — | — | — | — | — | — |
| Comparative example 6 | — | — | — | — | — | — | — | — | — | — | — | — |

TABLE 5

| | 2.5 GHz | | | | | | 3.0 GHz | | | | | |
|---|---|---|---|---|---|---|---|---|---|---|---|---|
| | μ' | μ'' | tanδμ | ε' | ε'' | tanδε | μ' | μ'' | tanδμ | ε' | ε'' | tanδε |
| Example 1 | 1.801 | 0.101 | 0.056 | 6.059 | 0.087 | 0.014 | 1.807 | 0.141 | 0.078 | 6.038 | 0.109 | 0.018 |
| Example 2 | 1.804 | 0.098 | 0.055 | 6.166 | 0.114 | 0.018 | 1.809 | 0.141 | 0.078 | 6.145 | 0.134 | 0.022 |
| Example 3 | 1.843 | 0.107 | 0.058 | 6.344 | 0.123 | 0.019 | 1.849 | 0.150 | 0.081 | 6.319 | 0.145 | 0.023 |
| Example 4 | 1.810 | 0.098 | 0.054 | 6.098 | 0.088 | 0.014 | 1.816 | 0.136 | 0.075 | 6.076 | 0.110 | 0.018 |
| Example 5 | 1.927 | 0.139 | 0.072 | 6.634 | 0.172 | 0.026 | 1.932 | 0.190 | 0.098 | 6.603 | 0.193 | 0.029 |
| Example 6 | 1.895 | 0.125 | 0.066 | 6.625 | 0.212 | 0.032 | 1.902 | 0.172 | 0.090 | 6.590 | 0.233 | 0.035 |
| Example 7 | 1.785 | 0.097 | 0.054 | 5.927 | 0.078 | 0.013 | 1.790 | 0.134 | 0.075 | 5.907 | 0.101 | 0.017 |
| Example 8 | 1.794 | 0.092 | 0.051 | 6.236 | 0.168 | 0.027 | 1.803 | 0.128 | 0.071 | 6.204 | 0.187 | 0.030 |
| Example 9 | 1.770 | 0.095 | 0.054 | 6.348 | 0.156 | 0.025 | 1.774 | 0.132 | 0.074 | 6.323 | 0.178 | 0.028 |
| Example10 | 1.830 | 0.129 | 0.071 | 6.007 | 0.102 | 0.017 | 1.829 | 0.174 | 0.095 | 5.986 | 0.125 | 0.021 |
| Example 11 | 1.898 | 0.132 | 0.069 | 6.358 | 0.196 | 0.031 | 1.902 | 0.179 | 0.094 | 6.327 | 0.211 | 0.033 |
| Example 12 | 1.871 | 0.135 | 0.072 | 6.029 | 0.133 | 0.022 | 1.870 | 0.188 | 0.101 | 6.005 | 0.152 | 0.025 |
| Example 13 | 1.911 | 0.131 | 0.068 | 6.141 | 0.221 | 0.036 | 1.921 | 0.181 | 0.094 | 6.096 | 0.234 | 0.038 |
| Example 14 | 1.758 | 0.095 | 0.054 | 5.977 | 0.096 | 0.016 | 1.764 | 0.133 | 0.075 | 5.957 | 0.119 | 0.020 |
| Example15 | 1.934 | 0.120 | 0.062 | 6.928 | 0.124 | 0.018 | 1.950 | 0.168 | 0.086 | 6.900 | 0.149 | 0.022 |
| Example16 | 1.467 | 0.050 | 0.034 | 3.984 | 0.046 | 0.012 | 1.475 | 0.068 | 0.046 | 3.970 | 0.061 | 0.015 |
| Example 17 | 1.732 | 0.082 | 0.047 | 5.285 | 0.077 | 0.014 | 1.742 | 0.116 | 0.066 | 5.268 | 0.096 | 0.018 |
| Example 18 | 1.903 | 0.113 | 0.059 | 5.875 | 0.079 | 0.013 | 1.916 | 0.156 | 0.082 | 5.852 | 0.100 | 0.017 |
| Example 19 | 1.789 | 0.080 | 0.045 | 5.362 | 0.074 | 0.014 | 1.808 | 0.114 | 0.063 | 5.338 | 0.092 | 0.017 |
| Example 20 | 1.809 | 0.090 | 0.050 | 5.917 | 0.084 | 0.014 | 1.823 | 0.127 | 0.070 | 5.896 | 0.105 | 0.018 |
| Comparative example 1 | 1.922 | 0.163 | 0.085 | 6.399 | 0.485 | 0.076 | 1.919 | 0.212 | 0.111 | 6.333 | 0.496 | 0.078 |
| Comparative example 2 | 1.987 | 0.178 | 0.090 | 7.399 | 0.673 | 0.091 | 1.978 | 0.241 | 0.122 | 7.312 | 0.682 | 0.093 |
| Comparative example 3 | — | — | — | — | — | — | — | — | — | — | — | — |
| Comparative example 4 | — | — | — | — | — | — | — | — | — | — | — | — |
| Comparative example 5 | — | — | — | — | — | — | — | — | — | — | — | — |
| Comparative example 6 | — | — | — | — | — | — | — | — | — | — | — | — |

The blanks in each table are items that have not been measured or cannot be measured.

Example 1

In this example, a small amount of sample was prepared.

First, metal magnetic powder (iron-cobalt metal particles, long axis length: 40 nm, BET: 37.3 $m^2/g$, σs: 179.3 $Am^2/kg$, carbon content (high frequency combustion method): 0.01 Mass % manufactured by DOWA ELECTRONICS CORPORATION) was sieved with a 500 mesh sieve, and phthalic acid (special grade reagent manufactured by Wako Pure Chemical Industries, Ltd.) was added to the sieved metal magnetic powder (50 g) by 5% (2.5 g) with respect to the magnetic powder, and ethanol was added to the sieved metal magnetic powder (50 g) by 30 wt % (15 g) with respect to the magnetic powder, and mixed in an agate mortar for 5 minutes. Drying was performed at 60° C. for 2 hours to obtain a magnetic powder composite in this example. The true density of the obtained magnetic powder composite was obtained by a gas phase (He gas) substitution method, and it was found to be 5.58 $g/cm^3$. The value of the obtained true density was used for calculating a mixing ratio for setting the content of the magnetic powder composite in the compound to a desired ratio.

In a small kneader (DSM Xplore (registered trademark) MC 15, manufactured by Xplore Instruments) placed in an atmosphere filled with nitrogen until an oxygen concentration meter reaches 0%, the magnetic powder composite was mixed in a melted resin while melting 13.2 g of polyphenylene sulfide resin (JURAFIDE (registered trademark) 0220 A9 manufactured by PPS/Polyplastic Co., Ltd.) at a kneading stirring speed of 100 rpm at a set temperature of 300° C. An amount of the magnetic powder composite was 23.4 g corresponding to a volume filling rate of 30 vol % at the time of forming a molded body. Then, kneading was performed for 10 minutes (including the time for charging the resin and the magnetic powder) to thereby prepare a kneaded product, that is, a magnetic compound.

The obtained magnetic compound was charged into an injection molding machine as an option device of a small kneader under conditions of a cylinder temperature of 300° C. and a mold temperature of 130° C. to thereby prepare a molded body for a bending test (ISO 178 standard size: 80 mm×10 mm×4 mm), and thereafter the bending strength was measured with a distance between fulcrums set to 16 mm, using a digital force gauge (ZTS-500N manufactured by Imada Inc.), to thereby calculate a bending displacement and measure the elastic modulus (MPa).

Further, in order to measure the high-frequency property, 0.2 g of the magnetic compound was charged into a donut-shaped jig having a diameter of 6 mm, and thereafter heated at 300° C. for 20 minutes with a small hot press machine (manufactured by AS ONE Corporation). In this manner, the resin is melted in the magnetic compound and thereafter molded into a toroidal shaped molded body having an outer diameter of 7 mm and an inner diameter of 3 mm while being pressurized and cooled. The high frequency property of the obtained molded body was measured by the method described in the abovementioned embodiment.

Example 2

In this example, the procedure was the same as example 1 except that a treatment agent to be added in example 1 was maleic anhydride.

Example 3

In this example, the procedure was the same as example 1 except that the treatment agent to be added in example 1 was maleic acid.

Example 4

In this example, the procedure was the same as example 1 except that the treatment agent to be added in example 1 was dimethyl phthalate.

Example 5

In this example, the procedure was the same as example 1 except that the treatment agent to be added in example 1 was succinic acid.

Example 6

In this example, the procedure was the same as example 1 except that the treatment agent to be added in example 1 was succinic anhydride.

Example 7

In this example, the procedure was the same as example 1 except that the treatment agent to be added in example 1 was phthalic anhydride.

Example 8

In this example, the procedure was the same as example 1 except that the treatment agent to be added in example 1 was benzoic acid.

Example 9

In this example, the procedure was the same as example 1 except that the treatment agent to be added in example 1 was malonic acid.

Example 10

In this example, the procedure was the same as example 1 except that the treatment agent to be added in example 1 was fumaric acid.

Example 11

In this example, the procedure was the same as example 1 except that the treatment agent to be added in example 1 was glutaric acid.

Example 12

In this example, the procedure was the same as example 1 except that the treatment agent to be added in example 1 was azelaic acid.

Example 13

In this example, the procedure was the same as example 1 except that the treatment agent to be added in example 1 was sebacic acid.

Example 14

In this example, a medium amount sample was prepared.

First, ethanol (special grade reagent manufactured by Wako Pure Chemical Industries, Ltd.) was added to 25 g of phthalic acid (special grade reagent manufactured by Wako Pure Chemical Industries, Ltd.) so as to be 500 g, and phthalic acid was dissolved in ethanol. 500 g of metal magnetic powder (iron-cobalt metal particles, long axis length: 40 nm, BET: 37.3 $m^2/g$, σs: 179.3 $Am^2/kg$, carbon content (high frequency combustion method): 0.01 mass % manufactured by DOWA ELECTRONICS CORPORATION) was added to the above solution under an inert atmosphere, so that the metal magnetic powder was precipitated in the solution. The mixture was stirred in the air at 8000 rpm for 2 minutes with a high-speed stirrer (TK Homomixer Mark II, manufactured by Primix Corporation), to thereby obtain a paste form of the metal magnetic powder.

The obtained paste was spread on an aluminum vat, heated for 1 hour at a temperature near an evaporation temperature of ethanol (78° C.), with the temperature raised to 120° C. and heated for 1.5 hours, and ethanol was removed from the paste to thereby obtain an aggregate in which phthalic acid and the metal magnetic powder were mixed. The obtained aggregate was passed through a 500 mesh sieve to remove coarse particles to thereby obtain a magnetic powder composite according to this example. The obtained magnetic powder composite had properties of BET: 34.9 $m^2/g$, σs: 173.5 $Am^2/kg$, and carbon content (high frequency combustion method): 2.82 mass %.

Here, the true density of the magnetic powder composite was obtained by a gas phase (He gas) substitution method, and the value of the obtained true density was used for calculating a mixing ratio for setting the content of the magnetic powder composite in the compound to a desired ratio.

The evaluation was made hereafter in the same manner as in example 1.

Example 15

In this example, the procedure was the same as example 14 except that the resin was changed to Jurafide (registered trademark) 1130 A64 (polyphenylene sulfide manufactured by PPS/Polyplastics Co., Ltd.) containing 30% of glass fiber and having a specific gravity of 1.57 $g/cm^3$.

Example 16

In this example, 11.5 g of the magnetic powder composite with a volume filling rate corresponding to 20 vol % at the time of forming a molded body, and 11.5 g of XAREC (registered trademark) SP 105 (SPS/syndiotactic polystyrene manufactured by Idemitsu Kosan Co., Ltd.) having a specific gravity of 1.18 $g/cm^3$, were respectively weighed in nitrogen atmosphere, and put in a No. 5 standard bottle and the bottle was covered. After slightly shaking the bottle with hands and stirring, the mixture was kneaded for 10 minutes (including the time for charging the resin and the magnetic powder) at a set temperature of 300° C. and a kneading stirring speed of 100 rpm in a nitrogen atmosphere, using a small kneader (DSM Xplore (registered trademark) MC 15, manufactured by Xplore Instruments), to thereby prepare a kneaded product, that is, a magnetic compound. The other procedure was the same as example 1 to perform evaluation.

Example 17

In this example, the procedure was the same as example 16 except that in example 16, addition amounts of the magnetic powder composite and SPS were adjusted so that a volume filling rate of the magnetic powder composite corresponds to 30 vol %.

Example 18

In this example, the procedure was the same as example 16 except that in example 16, the addition amount of the magnetic powder composite and SPS were adjusted so that the volume filling rate of the magnetic powder composite corresponds to 40 vol %.

Example 19

In this example, the procedure was the same as example 16 except that the resin was changed to ZYLON (registered trademark) AH-40 (PPE/modified polyphenylene ether manufactured by Asahi Kasei Chemicals Corporation) having a specific gravity of 1.06 $g/cm^3$.

Example 20

In this example, the procedure was the same as example 16 except that the resin is changed to ZYLON (registered trademark) GH-30 (PPE/modified polyphenylene ether manufactured by Asahi Kasei Chemicals Corporation) containing 30% of glass fiber and having a specific gravity of 1.31 $g/cm^3$.

Comparative Example 1

In this example, in example 1, the metal magnetic particles not surface-treated with phthalic acid were used. Further, instead of the thermoplastic resin, an epoxy resin (one-part type epoxy resin Tesc Co., Ltd.) which is a thermosetting resin was weighed so that the metal magnetic powder was 30 mass %, and the metal magnetic powder was dispersed in the epoxy resin to form a paste, using a vacuum stirring/defoaming mixer (V-mini 300) manufactured by EME Co., Ltd. This paste was dried on a hot plate at 60° C. for 2 hours to thereby obtain a metal magnetic powder-resin composite. This composite was granulated to prepare a composite powder, and 0.2 g of this composite powder was placed in a donut-shaped container, and by applying a load of 1 t by a hand press machine, a toroidal shaped molded body having an outer diameter of 7 mm and an inner diameter of 3 mm was obtained. The other procedure was the same as example 1, to perform evaluation.

Comparative Example 2

In this example, the procedure was the same except that the magnetic metal powder used in comparative example 1 was changed to the magnetic powder composite used in example 14.

Comparative Example 3

In this example, the procedure was the same except that in example 14, the metal magnetic powder was not surface-treated with phthalic acid.

In this example, during preparation of the kneaded product, the metal magnetic powder is ignited in a stage when the kneaded matter is discharged from the extruder die, thereby generating smoke, and therefore it was impossible to prepare a magnetic compound pellet from the beginning.

Comparative Example 4

In this example, the procedure was the same except that in example 17, the metal magnetic powder was not surface-treated with phthalic acid.

In this example, during preparation of the kneaded product, the metal magnetic powder is ignited in a stage when the kneaded matter is discharged from the extruder die, thereby generating smoke, and therefore it was impossible to prepare a magnetic compound pellet from the beginning.

Comparative Example 5

In this example, the procedure was the same except that in example 17, the metal magnetic powder was not surface-treated with phthalic acid.

In this example, during preparation of the kneaded product, the metal magnetic powder is ignited in a stage when the kneaded matter is discharged from the extruder die, thereby generating smoke, and therefore it was impossible to prepare a magnetic compound pellet from the beginning.

Comparative Example 6

In this example, it was confirmed whether the same effect was observed in the magnetic powder composite, using a mixed resin of thermoplastic resin and aromatic nylon, which is an existing technology. Specifically, the procedure was the same except that in example 1, the metal magnetic powder was not surface-treated with phthalic acid, and the resin was obtained by mixing Jurafide (registered trademark) (PPS/polyphenylene sulfide resin Polyplastics A0220A9), and aromatic nylon 6T BESTAMID (registered trademark) (HTplus M1000 manufactured by Daicel-Evonik).

In this example, during preparation of the kneaded product, the metal magnetic powder is ignited in a stage when the kneaded matter is discharged from the extruder die, thereby generating smoke, and therefore it was impossible to prepare a magnetic compound pellet from the beginning.

<Result>

The abovementioned contents are summarized in tables 1 to 5 listed above.

In each example of the abovementioned each table, all excellent values were obtained in all frequencies listed in each table, including the real part ($\mu'$) of permeability, the imaginary part ($\mu''$) of permeability, the real part ($\varepsilon'$) of permittivity, the imaginary part ($\varepsilon''$) of permittivity, ($\tan \delta\mu$) and ($\tan \delta\varepsilon$), and further standard deviation of $\mu'$ and $\varepsilon'$ at 750 MHz to 1 GHz. In addition, the bending strength and the elastic modulus were also excellent.

On the other hand, in comparative example, during preparation of the magnetic compound in comparative examples 3 to 6, smoke was generated before ignition, and a kneaded material could not be obtained.

In comparative examples 1 and 2, the magnetic compound could be prepared. However, the result was inferior to examples in terms of the high frequency property.

As a result thereof, according to the abovementioned examples, it becomes clear that it is possible to provide a magnetic powder composite and its related objects which can realize desired communication properties while enabling miniaturization of an electronic communication device.

The invention claimed is:

1. A magnetic powder composite, consisting of:

a metal magnetic powder; and one or more elements selected from carboxylic acid or its anhydride, aromatic carboxylic acid ester, and a derivative thereof, and having a molecular weight of 500 or less and a carbon number of from 4 to 30, as a coating material, having a property that real part $\mu'$ of permeability is 1.45 or more, $\tan \delta\mu$ is 0.1 or less, $\tan \delta\varepsilon$ is 0.05 or less at a measuring frequency of 2 GHz, when a magnetic powder composite is prepared by adding 5 parts by mass of one or more elements selected from the carboxylic acid or its anhydride, the aromatic carboxylic acid ester, and the derivative thereof to 100 parts by mass of the metal magnetic powder, and 30 vol % of the magnetic powder composite is contained in a thermoplastic resin in which the $\tan \delta\varepsilon$ is 0.05 or less at 1 MHz specified in IEC 60250 or JIS C 2138: 2007, wherein the coating material is one or more elements selected from the group consisting of phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate, and a derivative thereof, and a surface of the metal magnetic powder is coated with the coating material.

2. The magnetic powder composite according to claim 1, wherein the thermoplastic resin is a resin containing an aromatic ring.

3. A magnetic powder composite, consisting of:

a metal magnetic powder; and one or more elements selected from carboxylic acid or its anhydride, aromatic carboxylic acid ester, and a derivative thereof, and having a molecular weight of 500 or less and a carbon number of from 4 to 30, as a coating material, having a property that real part $\mu'$ of permeability is 1.45 or more, $\tan \delta\mu$ is 0.1 or less, $\tan \delta\varepsilon$ is 0.05 or less at a measuring frequency of 2 GHz, when a magnetic powder composite is prepared by adding 5 parts by mass of one or more elements selected from the carboxylic acid or its anhydride, the aromatic carboxylic acid ester, and the derivative thereof to 100 parts by mass of the metal magnetic powder, and 30 vol % of the magnetic powder composite is contained in a material containing one or more kinds of resins selected from SPS, m-PPE, and PPS, wherein the coating material is one or more elements selected from the group consisting of phthalic acid, phthalic anhydride, maleic acid, maleic anhydride, succinic acid, succinic anhydride, malonic acid, fumaric acid, glutaric acid, azelaic acid, sebacic acid, benzoic acid, dimethyl phthalate, and a derivative thereof, and a surface of the metal magnetic powder is coated with the coating material.

4. A magnetic compound, comprising:

the magnetic powder composite of claim 1; and one or more kinds of resins selected from SPS and m-PPE.

5. A magnetic compound, comprising:

the magnetic powder composite of claim 1 including one or more elements selected from maleic acid, maleic anhydride, succinic acid, succinic anhydride, malonic acid, fumaric acid, glutaric acid, azelaic acid, sebacic acid, benzoic acid and a derivative thereof, as the coating material; and PPS resin.

6. An antenna constituted by the magnetic powder composite of claim 1.

7. An electronic device including the antenna of claim 6.

* * * * *